United States Patent [19]

Mykleby

[11] 4,266,670

[45] May 12, 1981

[54] COLLAPSIBLE REINFORCED CONTAINER

[75] Inventor: Laurie G. Mykleby, Palos Park, Ill.

[73] Assignee: First National Packaging Co., Inc., Palos Park, Ill.

[21] Appl. No.: 59,239

[22] Filed: Jul. 20, 1979

[51] Int. Cl.[3] ..... B65D 5/36; B65D 19/06; B65D 6/34

[52] U.S. Cl. ..... 206/600; 206/386; 217/43 A; 217/65; 220/6; 220/445

[58] Field of Search ..... 206/600, 386; 220/6, 220/445; 217/43 A, 43 R, 65; 428/116

[56] References Cited

U.S. PATENT DOCUMENTS

| | | | |
|---|---|---|---|
| 695,677 | 3/1902 | Faris | 217/65 |
| 977,263 | 11/1910 | Biro | 220/6 |
| 1,648,591 | 11/1927 | Repay | 217/65 |
| 1,696,341 | 12/1928 | Blanchard | 220/445 |
| 2,477,852 | 8/1949 | Bacon | 220/445 |
| 2,986,245 | 5/1961 | Tuttle | 217/65 |
| 4,090,659 | 5/1978 | Galmiche et al. | 206/386 |

*Primary Examiner*—William T. Dixson, Jr.
*Attorney, Agent, or Firm*—Thomas W. Speckman

[57] ABSTRACT

A collapsible, reinforced, four sided container attached to a rigid base for transporting heavy products. The containers may be collapsed and shipped in reduced size for reuse and reassembled into its usable form without any special tools or skills. The collapsible container of this invention provides that one or more sides may be opened for loading or unloading.

9 Claims, 8 Drawing Figures

107
42b
110
108

42a
101
109
103
105
42d
11
13
31
42c
43b
32
10d
32
31
43a
31
12
32
1d
106
31
102
32
40

COLLAPSIBLE REINFORCED CONTAINER

BACKGROUND OF THE INVENTION

1. Field of the Invention

This invention relates to a collapsible, reinforced, four sided container attached to a rigid base, of the type for transporting heavy products, such as iron. More particularly, this invention relates to heavy duty containers which may be collapsed and shipped in reduced size for reuse. The containers, due to their heavy loaded weight and size, are usually moved with a forklift and therefore, must have a rigid base. It is also desirable for the collapsed container to be assembled into its usable form without any special tools or skills. The collapsible container of this invention also provides that one or more sides may be opened for loading or unloading.

2. Description of the Prior Art

A reinforced collapsible container fabricated from conventional corrugated cardboard wherein the reinforcing is achieved by doubling layers of cardboard is taught by U.S. Pat. No. 3,949,874. However, the teachings of the U.S. Pat. No. 3,949,874 do not provide for containers which are reinforced by having the side walls substantially thickened by internal reinforcing, nor do the teachings provide a reinforced collapsible container which may be opened on one side for loading or unloading. The U.S. Pat. No. 3,949,874 teaches the bottom wall being attached to a rigid reinforcing frame and teaches upright rigid members preferably being secured to the walls of the four corners of the container for providing upright rigidity support. Palletized shipping containers having rigid corner supports are also taught by U.S. Pat. Nos. 3,372,855; 3,294,306; and 3,071,277, while a removable pin strap hinge corner connection for a collapsible container is taught by U.S. Pat. No. 3,451,578. Various joints and forms for collapsible containers are taught by U.S. Pat. Nos. 2,396,140; 2,399,590; 2,920,809; 2,961,139; 3,333,720; and 3,722,928.

SUMMARY OF THE INVENTION

The present invention provides a collapsible reinforced container attached to a rigid base which may have internal side wall reinforcing providing a container suitable for transporting heavy goods, such as heavy metal, while still providing a container which, when empty, may be folded flat for shipping for reuse. The container of this invention can be assembled without specialized tools or specialized skills. The container of this invention provides rigid corner supports. The container of this invention provides a reinforced corrugated cardboard container of which one side may be easily opened for loading or unloading.

These and other advantages are provided by a collapsible, reinforced, four sided container attached to a rigid base wherein a first and second side wall comprise a first pair of opposed reinforced rectangular side walls, each hingedly connected to a bottom flap along the bottom of the reinforced side wall, the bottom flap connected to the first side wall having an additional fold score parallel to and spaced from the hinge connection and the bottom flap connected to the second side wall having a fold score parallel to and spaced from the hinge connection; the third and fourth side wall providing a second pair of opposed reinforced rectangular side walls, each hingedly connected to a separate bottom flap, each of the separate bottom flaps having a fold score parallel to and spaced from the hinge connection of each the third and fourth side walls, the spacing of the fold scores providing overlaying of the sides to collapse the side walls flatly; each of the first pair of reinforced side walls having fastening means along each edge adjacent to and at right angles to the hinge connection and each of the second pair of reinforced side walls having a mating fastening means along each edge adjacent to and at right angle to the hinge connection, the fastening means and mating means being engagable with each other when the reinforced side walls are perpendicular to the bottom flaps; and the bottom flaps of the first pair of opposed side walls attached to a rigid base inwardly from the sides enclosed by the second pair of side walls, the bottom flap of the second pair of side walls slidable between the first opposed sides bottom flaps and the rigid base. The container is readily collapsed by disengaging the mating and fastening means along each corner, folding one side wall so its interior face is adjacent the inner face of the bottom, folding a second side wall so that its interior face is adjacent the inner face of the bottom or the exterior face of the first side wall, sliding the third and fourth side walls outwardly to each of the fold scores on their respective bottom flaps and folding each third and fourth side wall so its inner face is adjacent the outer face of one or both of the side walls. The container may be reassembled for reuse by reversal of this process.

BRIEF DESCRIPTION OF THE DRAWINGS

Objects and advantages of the invention will become apparent from the following description taken in conjunction with the accompanying drawings showing preferred embodiments wherein.

DESCRIPTION OF THE PREFERRED EMBODIMENTS

Figure 1:
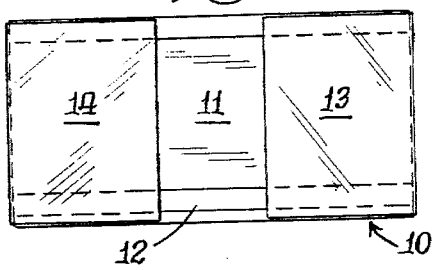
FIG. 1 is a top view of a container of this invention in collapsed condition.
Figure 2:
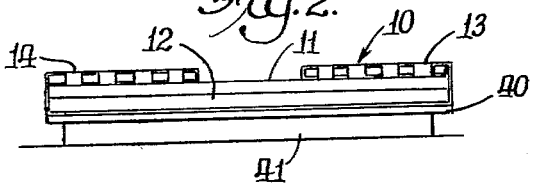
FIG. 2 is a side view of a container of this invention in collapsed condition.

Referring to the figures, FIGS. 1 and 2 show one embodiment of the collapsible container of this invention in collapsed condition. Collapsible container shown generally as 10, is mounted to rigid base pallet platform 40 having pallet skids 41. The container shown in FIGS. 1 and 2 is of the type having a rectangular shape wherein the length is about twice the width and the height is approximately the same as the width. In a collapsible container of this invention having such proportions one long side 12 is folded to overlay the container bottom attached to the pallet platform, opposing long side all is folded to overlay side 12, and short sides 13 and 14, having their bottom flaps between the side bottom flaps and pallet platform 40, are slid outwardly to their respective fold score appropriately spaced from the hinged connection between the short sides and their bottom flap so that the short sides may be folded to overlay both long sides as best seen in FIG. 2.

Figure 3:
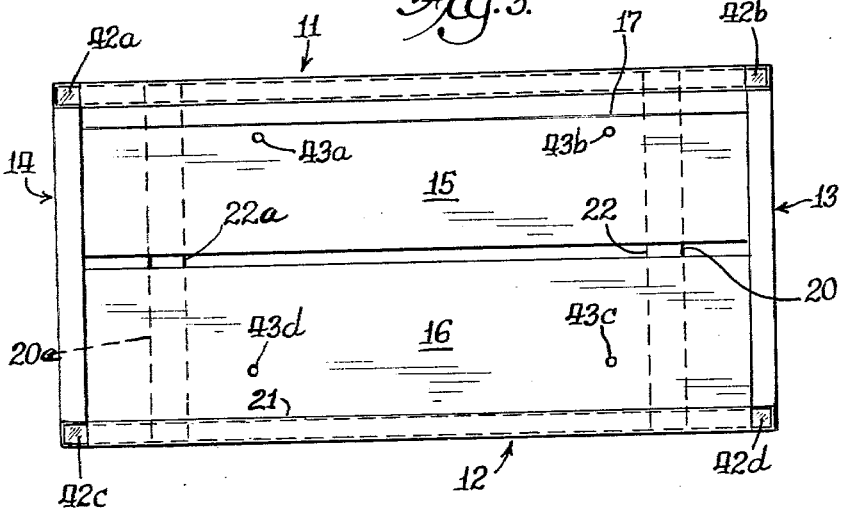
FIG. 3 is a top view of a container of this invention, without a top, in assembled condition.

FIG. 3, a top view of an assembled container of this invention, shows long sides 11 and 12 and short sides 13 and 14, fastenably engaged at their corners with corner posts 42*a*, 42*b*, 42*c* and 43*d*. As shown in FIG. 3, side 11 and its hingedly connected bottom flap 15 is a separate assembly from side 12 and its hingedly connected bottom flap 16, each bottom flap 15 and 16 being firmly affixed rigid platform 40 by fasteners 43*a*, 43*b*, 43*d* and 43*c* spaced inwardly from the short sides. It is readily apparent to one skilled in the art that sides 11 and 12 may be fabricated from a single sheet of material with bottom flaps 15 and 16 being a single interconnecting sheet and use of the term "bottom flap" with respect to those sides encompasses both types of construction. Bottom flap 16 has fold score 21 spaced from its hinged connection with side wall 12 so that in collapsed condition the inner face of side wall 12 is adjacent the top of the bottom flaps. Bottom flap 15 has fold score 17 spaced from the hinged connection of side wall 11 and bottom flap 15 so that in collapsed condition the inner surface of side wall 11 is adjacent the outer surface of side wall 12. It is readily apparent that when the height of the side walls is less than half the width of the container, fold score 17 may be located in a position similar to fold score 21 so that the inner surface of both sides 11 and 12 are adjacent the top of the bottom flaps when folded. Short sides 13 and 14 are hingedly connected to their respective bottom flaps 22 and 22*a*. Bottom flaps 22 and 22*a* have fold score 20 and 20*a* spaced from the hinged connection so that the bottom flaps may be pulled outwardly just exposing fold score 20 while retaining flap 22 in position between the long side bottom flaps 15 and 16 and pallet platform 40 allowing short sides 13 and 14 to be folded to overlay and be adjacent to one of the long sides as shown in FIGS. 1 and 2, or if a shallow container is used, the inner face of the short sides may be adjacent the outer face of both long sides.

Figure 7:
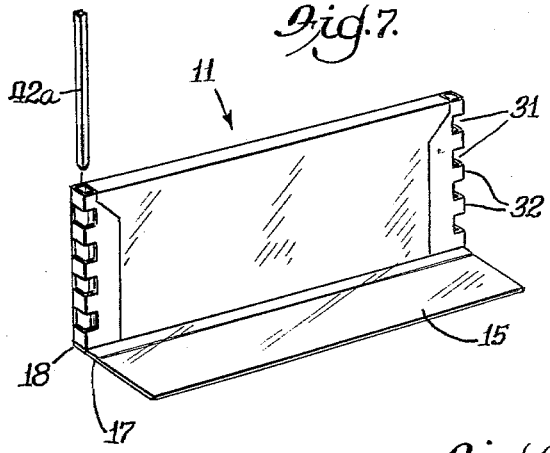
FIG. 7 is a perspective view, from the inside, of a side wall of a container of this invention.
Figure 6:
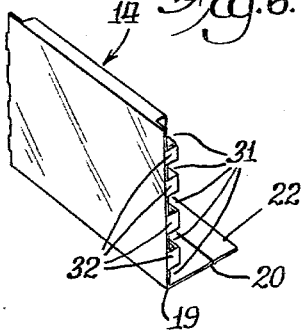
FIG. 6 is a perspective view, from the outside, of one end side wall of a container of this invention.
Figure 4:
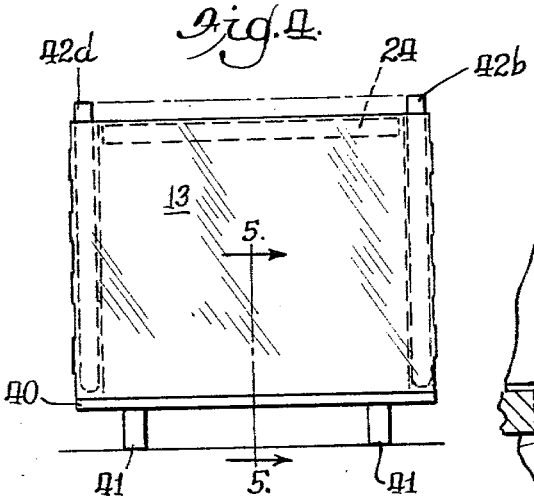
FIG. 4 is an end view of a container of this invention in assembled condition.

Corner details of a preferred embodiment of this invention may best be seen in FIGS. 6 and 7. FIG. 6 shows short side 14 with its hinged connection 19 and flap 22 having fold score 20. Each side of short side 14 adjacent the hinged connection has fastening means shown as mortise 31 and tenon 32. Likewise, long side 11 is shown in FIG. 7 with bottom flap 15 hingedly connected to side 11 at hinge connection 18 with the sides of side 11 adjacent the hinge connection having mating fastening means shown as mortise 31 and tenon 32. The mortise and tenon elements of short side 14 mate with the mortise and tenon elements of adjacent long side 11 and corner post 32*a* is inserted in the mated corner fastening means providing both secured fastening and vertical rigidity for stacking of containers. As shown in the figures, all four corners of the container have similar mortise and tenon joints. Any suitable material may be used for corner posts, such as wooden posts, metal pipes, and the like. It is desired that the corner posts extend from the top of the container, as shown in FIG. 4, to provide a hand hold for removing them in order to collapse the container. While the figures show a preferred embodiment of the container of this invention with mortise and tenon fastening and mating fastening means at the corners. It is readily apparent that any other fastening and mating fastening means providing secure fastening with easy unfastening may be used.

Figure 5:
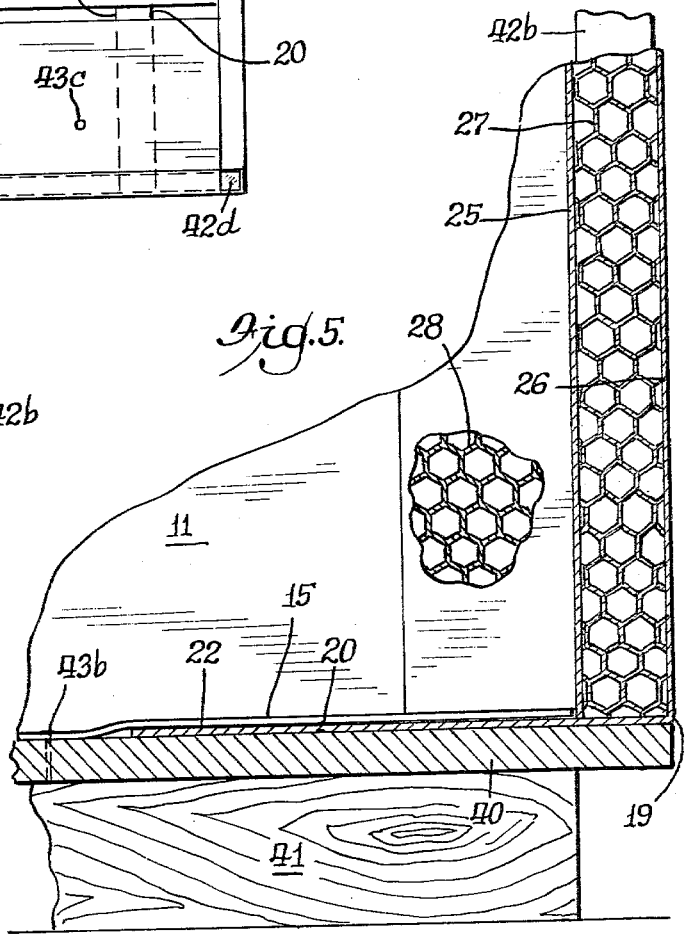
FIG. 5 is a partial sectional view as shown on line 5—5 of FIG. 4.

The walls and bottom flaps of the container of this invention may be fabricated from any desired material, particularly preferred is heavy duty corrugated cardboard. As best seen in FIG. 5, the side walls of one preferred container of this invention are double faced with interior reinforcing. The interior reinforcing may be corrugated or honeycomb paperboard structure, synthetic polymeric reinforcing, metallic framework reinforcing or wood reinforcing, either plywood or wood framework. For example, FIG. 5 shows parallel honeycomb 27 between inner face 25 and outer face 26 of side 13 and perpendicular honeycomb reinforcing 28 in side 11. The reinforcing may be readily enclosed between the inner and outer faces of the side wall which may be folded from a single sheet of cardboard. As best seen in FIG. 7, the holes for the mortise component of the corner fastening means may be cut from a single layer flap extending from the side wall and may be readily reinforced by taping the area with reinforcing tape prior to cutting, and then folding and fastening to retain the side wall reinforcing as shown in the figure. Specific stress areas of the container may be locally reinforced, as for example, as shown in FIG. 4 short side 13 has an internal upper reinforcement 24 which may be wood or metal and is particularly useful when the containers are stacked. Vertical rigidity may also be enhanced when the containers are stacked if the corner posts extend upward to bear some of the weight of the stacked containers.

The container of this invention may have, if desired, any type of suitable cover. The cover may be separate with downwardly projecting sides to fit over the four sides of the container or may be hingedly connected to one or more of the side walls as long as it does not interfere with the desired collapsing as described above.

The bottom flaps are fastened to pallet platform 40 by any suitable means, such as nails or staples.

Figure 8:
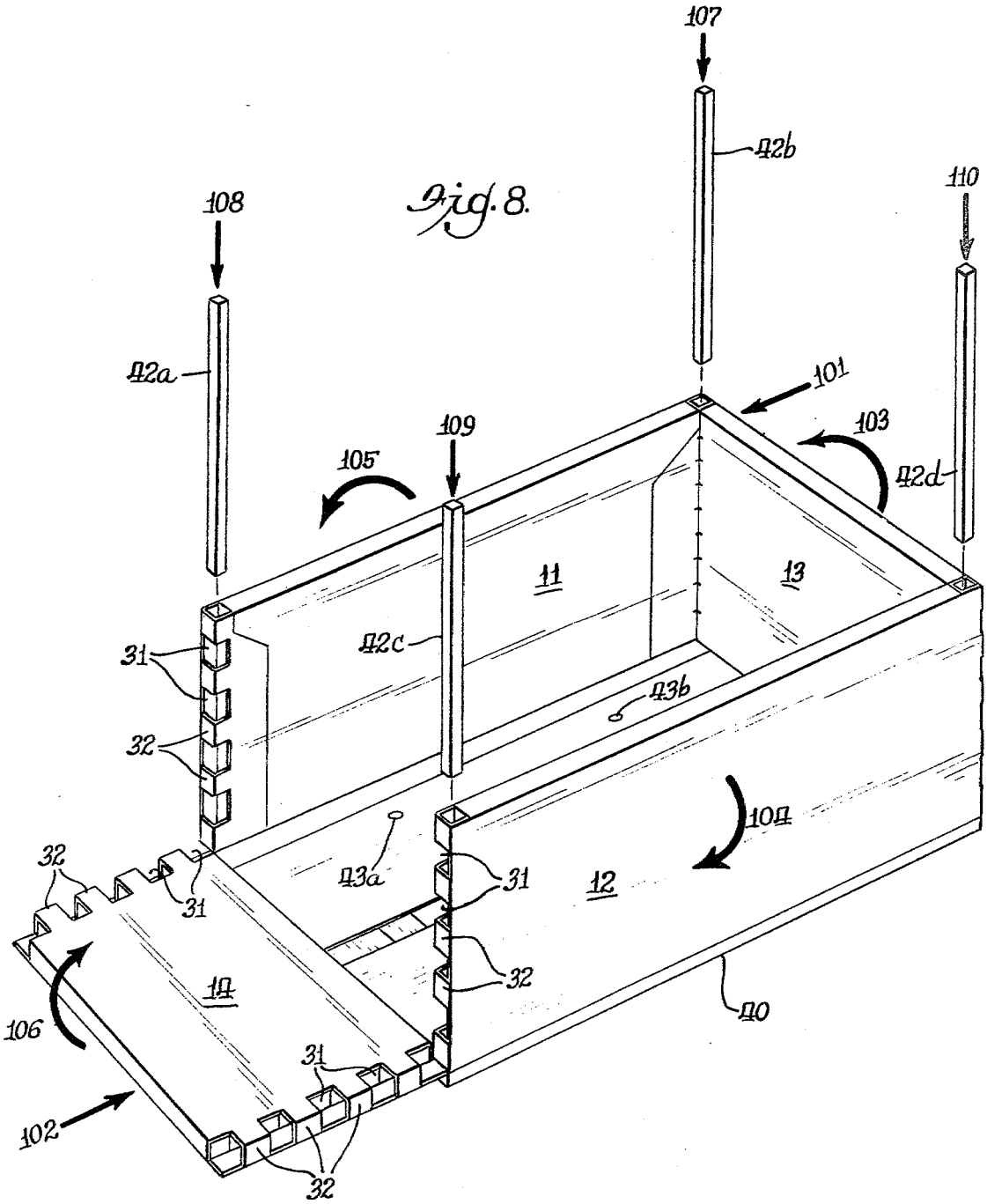
FIG. 8 is a perspective view showing the manner of assembly of the collapsible container of this invention.

One major advantage of the container of this invention is that it may be easily reassembled for use without any special tools or special skills. Such reassembly is shown in FIG. 8. To assemble the container from the condition as shown in FIGS. 1 and 2 to the condition as shown in FIGS. 3 and 4, it is necessary to fold short sides 13 and 14 out flat and then push each short side inwardly so that the bottom flaps are completely between the long side bottom flaps and the pallet platform by the action shown by arrows 101 and 102 in FIG. 8. Long sides 11 and 12 may then be lifted to the position shown in FIG. 8 by lifting in the direction of the arrows 105 and 104, respectively. The short sides may be lifted by motion shown by arrows 103 and 106, respectively to engage the corner fastenings and corner posts 42*a*, 42*b*, 42*c* and 42*d* may be inserted by the action shown by arrows 108, 107, 109 and 110. The container is then in assembled condition and ready for reuse.

One feature of the container of this invention, as best seen in FIG. 8, is that one of the sides may be opened for easy loading or unloading of the contents by simply removing two corner posts and laying the side flat as shown with side 14 in FIG. 8. Likewise, long side 12 may be folded flat in a similar fashion by removing corner posts 42*c* and 42*d*.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A collapsible, reinforced, four sided container attached to a rigid base comprising: a first and second side wall comprising a first pair of opposed reinforced rectangular side walls having an inner and outer face with reinforcing therebetween, each of said side walls being hingedly connected to a bottom flap along the bottom of said reinforced side wall, the bottom flap connected to said first side wall having an additional fold score parallel to and spaced from said hinge connection and the bottom flap connected to said second side wall having a fold score parallel to and spaced from said hinge connection; a third and fourth side wall comprising a second pair of opposed reinforced rectangular side walls having an inner and outer face with reinforcing therebetween, each of said side walls being hingedly connected to a separate bottom flap, each of said separate bottom flaps having a fold score parallel to and spaced from said hinge connection of each of said third and fourth side walls, the spacing of said fold scores providing overlaying of the sides to collapse the side walls flatly; each of said first pair of reinforced side walls having fastening means along each edge adjacent and at right angle to said hinge connection and each of said second pair of reinforced side walls having a mating fastening means along each edge adjacent and at a right angle to said hinge connection, said fastening means and mating means engageable with each other when the reinforced side walls are perpendicular to said bottom flaps; and the bottom flaps of said first pair of opposed side walls attached to a rigid base inwardly from the sides enclosed by said second pair of side walls, the bottom flap of said second pair of side walls slidable between the bottom flaps of the first opposed sides and the rigid base.

2. The collapsible, reinforced container of claim 1 wherein said reinforcing is a honeycomb structure having the apertures of the honeycomb at right angles to said faces.

3. The collapsible, reinforced container of claim 1 wherein said reinforcing is a honeycomb structure having the apertures of the honeycomb parallel to said faces.

4. The collapsible, reinforced container of claim 1 wherein said reinforcing is wood.

5. The collapsible, reinforced container of claim 1 wherein said reinforcing is a metallic framework.

6. The collapsible, reinforced container of claim 1 wherein said fastening means and mating fastening means are mortice and tenon joints maintained engaged by corner posts.

7. The collapsible, reinforced container of claim 1 wherein said bottom flaps are single layers of corrugated paperboard.

8. The collapsible, reinforced container of claim 1 wherein the height of said container is approximately equal to the width and said fold score on the bottom flap connected to the first side wall is spaced at a distance of about the thickness of said reinforced side walls from said hinge connection, said fold score on the bottom flap connected to said second side wall is spaced at a distance of about twice the thickness of said reinforced side walls from said hinge connection, and said fold scores on each bottom flap connected to said third and fourth side walls is spaced at a distance of about three times the thickness of the side walls.

9. The collapsible, reinforced container of claim 8 wherein the side walls are reinforced with honeycomb reinforcing and the fastening means and mating fastening means are mortice and tenon joints maintained engaged by corner posts.

* * * * *